US005253818A

United States Patent [19]

Craddock

[11] Patent Number: 5,253,818

[45] Date of Patent: Oct. 19, 1993

[54] DISPENSER FOR SHEET MATERIAL

[76] Inventor: Gary D. Craddock, 4942 Commonwealth Dr., Sarasota, Fla. 34242

[21] Appl. No.: 853,597

[22] Filed: Mar. 18, 1992

[51] Int. Cl.[5] ..... B65H 16/02; B65H 16/04

[52] U.S. Cl. ..... 242/55.2; 242/68.4

[58] Field of Search ..... 242/55.2, 68.4, 55.53, 242/55.3

[56] References Cited

U.S. PATENT DOCUMENTS

| | | | |
|---|---|---|---|
| 2,583,411 | 1/1952 | Carlin | 242/55.53 |
| 2,948,486 | 8/1960 | Epeneter | 242/55.55 |
| 4,452,403 | 6/1984 | Arronte | 242/55.2 |
| 4,553,710 | 11/1985 | Pool | 242/55.53 X |
| 4,634,067 | 1/1987 | White | 242/55.2 |

FOREIGN PATENT DOCUMENTS

| | | | |
|---|---|---|---|
| 1185714 | 2/1959 | France | 242/55.53 |

*Primary Examiner*—William A. Cuchlinski, Jr.
*Assistant Examiner*—Alvin Wirthlin
*Attorney, Agent, or Firm*—Charles J. Prescott

[57] ABSTRACT

A dispenser for holding sheet material in a roll such as toilet tissue having a tubular hollow center. The dispenser may be incorporated into or attachable to a support surface or provided as an insert connectably supportable within an existing conventional roll holder. The invention includes a U-shaped support member having spaced apart generally parallel legs within which the roll will fit. End pieces are pivotally connected to the inner surface of each leg and are pivotally spring biased transversely toward one another in a roll engaging position from which only inward pivotal movement is structurally permitted. By this arrangement, each tissue roll may be one-handedly supportively engaged between the end pieces by pressing the roll equally against each end piece thus pivotally deflecting each end piece inwardly until they snap back into engagement with the tubular center. Removal of the empty tubular center is effected with a similar motion.

6 Claims, 1 Drawing Sheet

DISPENSER FOR SHEET MATERIAL

BACKGROUND OF THE INVENTION

This invention relates generally to dispensers for holding material arranged in a roll, and more particularly to such a device which is easily loadable with one hand.

Devices for holding roll material such as rolled toilet tissue are well known. A number of such devices have been patented in the past which have attempted to facilitate installation of each new tissue roll and the removal of the remaining tubular center when the roll is emptied of tissue.

The simplest of such devices is in the form of a cylindrical shaft over which the roll fits which is compressable against a spring bias from a fixed length for allowing this member to be removable and installable within a generally U-shaped rigid frame having cavities on the inner surface of each leg of the U-shaped structure. However, the installation and removal of this compressible member is normally a two-handed operation and frustrating at best.

The following U.S. patents have been invented to, in some way, overcome this limitation:

| | | | |
|---|---|---|---|
| 515,849 | 1,229,430 | 1,229,431 | 1,187,705 |
| 1,523,491 | 1,625,190 | 2,555,885 | 3,138,340 |
| 3,428,267 | 3,467,330 | 3,584,817 | 3,841,576 |
| 3,847,365 | 3,878,998 | 3,986,677 | 4,179,077 |
| 4,304,367 | 4,381,083 | 4,416,425 | 4,452,403 |
| 4,634,067 | | | |

However, various limitations with respect to both function and/or manufacturing costs persist with respect to such devices.

The present invention provides an improved dispenser for holding rolled sheet material such as bathroom tissue which truly facilitates one-handed installation of each tissue roll, rendering its inadvertent removal during use extremely difficult, if not impossible, and for the easy one-handed removal of the remaining tubular center member after all tissue has been removed.

BRIEF SUMMARY OF THE INVENTION

This invention is directed to a dispenser for holding sheet material in a roll such as toilet tissue having a tubular hollow center. The dispenser may be incorporated into or attachable to a support surface or provided as an insert connectably supportable within an existing conventional roll holder. The invention includes a U-shaped support member having spaced apart generally parallel legs within which the roll will fit. End pieces are pivotally connected to the inner surface of each leg and are pivotally spring biased transversely toward one another in a roll engaging position from which only inward pivotal movement is structurally permitted. By this arrangement, each tissue roll may be one-handedly supportively engaged between the end pieces by pressing the roll equally against each end piece thus pivotally deflecting each end piece inwardly until they snap back into engagement with the tubular center. Removal of the empty tubular center is effected with a similar motion.

It is therefore an object of this invention to provide an improved dispenser for holding sheet material in roll form which is fully functional with one-handed operation.

It is another object of this invention to provide an improved dispenser for holding sheet material in roll form which resists inadvertent removal of the roll during normal use.

It is yet another object of this invention to provide an improved dispenser for holding sheet material in roll form which easily facilitates one-handed removal of the tubular center of the roll when empty or at a point of predetermined reduced diameter.

It is yet another object of this invention to provide a dispenser insert for accomplishing the above objects which may be readily installable into existing roll toilet tissue fixtures.

In accordance with these and other objects which will become apparent hereinafter, the instant invention will now be described with reference to the accompanying drawings.

DETAILED DESCRIPTION OF THE INVENTION

Figure 1:
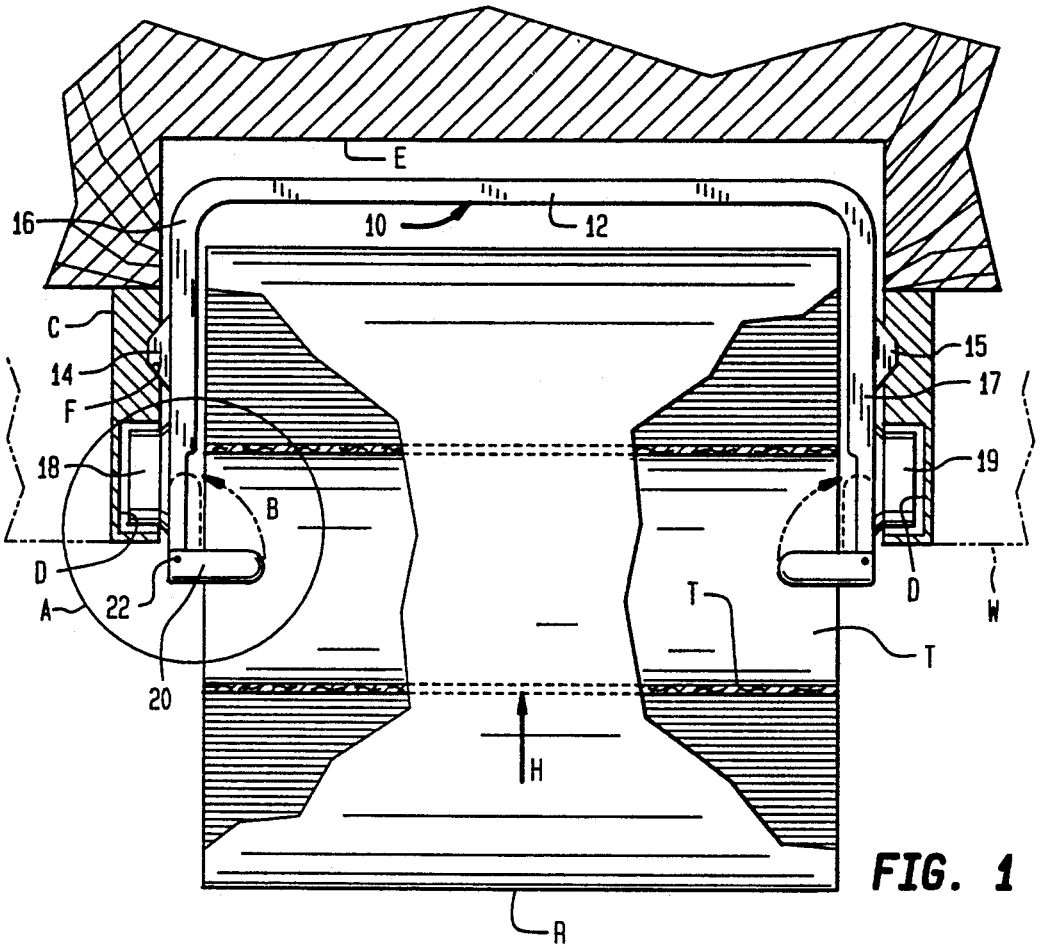
FIG. 1 is a top plan partial section view of the invention with a roll of tissue paper installed therein.
Figure 3:
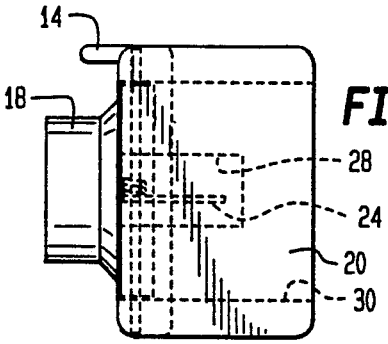
FIG. 3 is a view in the direction of arrows 3—3 in FIG. 2.

Referring now to the drawings, the preferred embodiment of the invention is shown generally at numeral 10 and includes a U-shaped molded frame 12 having generally parallel legs 16 and 17 spaced apart so as to receive a roll of sheet tissue R positioned therebetween as shown in FIG. 1. Each roll R is cylindrical and having a plurality of connected sheet tissues in a well-known fashion wrapped about a plastic or cardboard tubular center T.

Pivotally connected at each end of each leg 16 and 17 about upright pin 22 is a generally rectangular end piece 20 which is sized in width to slide within and position tube T. Each end piece 20 is cooperatively structured having molded cavities 26, 28, and 30 so as to receive wire spring 24 also pivotally connected about pin 22 as shown. Cavity 30 is provided so that each end piece 20 may be pivoted in the direction of arrow B to a position flat against and in alignment with each leg 16 or 17 and so that the inner surfaces thereof are generally coplaner.

Figure 2:
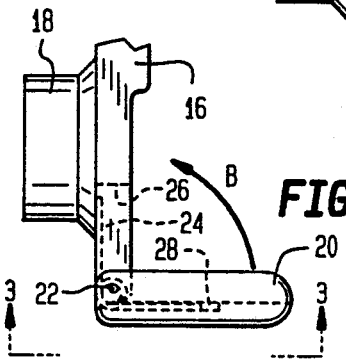
FIG. 2 is an enlarged view of region A in FIG. 1.
Figure 4:
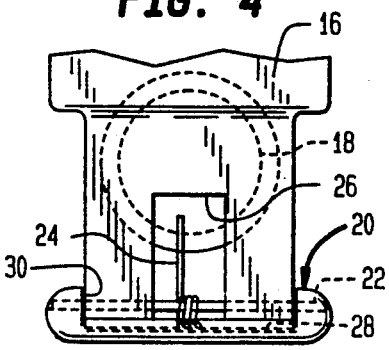
FIG. 4 is a right end elevation view of FIG. 2.

End pieces 20 are also cooperatively structured with the distal ends of each leg 16 and 17 so as to prevent outward pivotal movement beyond an orthogonal position with respect to each leg 16 and 17 as best seen in FIGS. 1 and 2. This pivotal limitation is provided so that the roll R may not be pulled from disengagement around legs 20.

The preferred embodiment 10 includes cylindrical extensions 18 and 19 which are securable within cavity D formed into a conventional roll tissue holder having molded members C extending from a cabinet or wall member into which a cavity E has been formed. In conventional use, a compressible rod is fitted within and between cavities D to hold the tissue roll R.

The preferred embodiment 10 takes advantage of this existing structure by allowing the installation thereof by simply squeezing legs 16 and 17 elastically toward one another until extensions 18 and 19 are fitted within cavities D.

The existing bracket C may also include a cavity F and the preferred embodiment 10 correspondingly includes tabs 14 and 15 which are molded onto the outer surface of each leg 16 and 17, respectively. If no such cavity F is provided, these tabs 14 and 15 will contact against the upper or lower edge of each bracket C. These tabs 14 and 15 prevent rotation of support member 12 when engaged within cavities F or against the edge of brackets C.

An alternate embodiment of the invention is shown in phantom in FIG. 1 wherein the entire device is connectable within opposing cavities D formed into a cabinet or wall structure W having cavity E formed therewithin to receive the device 10 as previously described. As yet another alternative, the entire device may be permanently built into a suitably prepared cavity E within a wall or cabinet which includes cavities D and F as previously described.

When the tissue roll R has been sufficiently depleted in diameter or completely emptied, leaving only the tubular center member T, removal is again a simple one-handed operation by pressing inwardly in the direction of arrow H. This movement of tube T causes each end piece 20 to be inwardly pivoted in the direction of arrow B against each leg 16 as shown in phantom in FIG. 1 so that the tube T may be easily removed thereafter.

Note that the depth of U-shaped support member 12 is such that a full or partially full roll R may not be moved an inward distance sufficiently by pressing in the direction of arrow H so as to cause this disengagement. By this arrangement, inadvertent removal of the tissue roll R during use is less likely with the present invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A dispenser for sheet material arranged in a roll having a hollow tubular center and a standardized length, said dispenser comprising:

a main U-shaped support member having spaced generally parallel outwardly extending legs between which the length of the roll will fit;

an end piece pivotally connected to and transversely extending toward one another from each leg and opposingly aligned one to another in a roll engaging position;

each said end piece spring biased into the roll engaging position and having stop means for preventing pivotal movement in any direction except for inward pivotal movement of each said end piece from the roll engaging position toward a roll disengaging position wherein the roll, when depleted, may be removed by movement to disengage said end pieces from within the tubular center, said end pieces automatically returning to the roll engaging position thereafter;

said legs sized in length in relation to a nominal diameter of the roll, when the roll is new, to prevent the new roll from being moved into the disengagement position;

each said leg including extensions transversely extending away from one another and sized and spaced apart to be secured within an existing roll holder having opposing facing spaced apart cavities for receiving an elongated spool positioned through the tubular center.

2. A dispenser for sheet material as set forth in claim 1, wherein:

said end pieces, when in their roll engaging position, generally coplaner one to another, each said end piece pivotally movable from the engaging position inwardly through approximately 90 degrees to the roll disengaging position wherein each said end piece is against the corresponding said leg.

3. A dispenser insert for holding sheet material arranged in a roll having a hollow tubular center, said insert structured for use in connection with a conventional roll holder, said dispenser insert comprising:

a main U-shaped support member having spaced generally parallel outwardly extending legs between which the length of the roll will fit;

an end piece pivotally connected to and transversely extending toward one another from each leg and opposingly aligned one to another;

each said end piece spring biased into a roll engaging position and cooperatively structured with the corresponding said leg to allow only independent inward pivotal movement of each said end piece from the engagement position toward a roll disengaging position whereby the roll, when depleted, may be removed by its inward movement to disengage said end pieces from within the tubular center, said end pieces automatically returning to the roll engaging position thereafter;

each said leg having a protrusion transversely extending away from each said end piece structured for supportive insertion into a first cavity formed in a side wall at each end of the roll holder.

4. A dispenser for sheet material as set forth in claim 5, wherein:

said end pieces, when in their roll engaging position, generally coplaner one to another, each said end piece pivotally movable from the engaging position inwardly through approximately 90 degrees to the roll disengaging position wherein each said end piece is against the corresponding said leg.

5. A dispenser for sheet material as set forth in claim 6, further comprising:

an alignment tab laterally extending from each said leg in the same direction as the corresponding said protrusion structured for supportive engagement within a second cavity formed in each roll holder side wall;

said protrusions and said alignment tabs cooperatively structured, when within said first and second cavities, securing said dispenser insert within the roll holder.

6. A dispenser for sheet material as set forth in claim 5, wherein:

said support member is structured to prevent inward movement of the roll a distance sufficient for disengagement from said end pieces until the roll is reduced in diameter a predetermined amount by removal of sheet material therefrom.

* * * * *